US009066185B2

(12) United States Patent
Koskowich et al.

(10) Patent No.: US 9,066,185 B2
(45) Date of Patent: Jun. 23, 2015

(54) IMPLANTABLE MICROPHONE

(75) Inventors: Gregory N. Koskowich, Pleasanton, CA (US); Brenda L. F. Fedor, Holladay, UT (US)

(73) Assignee: OtoKinetics Inc., Cincinnati, OH (US)

( * ) Notice: Subject to any disclaimer, the term of this patent is extended or adjusted under 35 U.S.C. 154(b) by 253 days.

(21) Appl. No.: 13/485,580

(22) Filed: May 31, 2012

(65) Prior Publication Data

US 2013/0315427 A1 Nov. 28, 2013

Related U.S. Application Data

(63) Continuation-in-part of application No. 13/478,056, filed on May 22, 2012.

(51) Int. Cl.
*H04R 25/00* (2006.01)
*H04R 9/08* (2006.01)

(52) U.S. Cl.
CPC ..... *H04R 25/00* (2013.01)

(58) Field of Classification Search
CPC ..... H04R 25/00; H04R 1/04; H04R 1/08; H04R 1/083; H04R 1/086; H04R 1/016; H04R 1/1058; H04R 1/19; H04R 1/342; H04R 1/38; H04R 1/406; H04R 9/08; H04R 11/00; H04R 17/00; H04R 19/00; H04R 19/01; H04R 19/02; H04R 19/04; H04R 19/016; H04R 2201/107; H04R 2225/67; H04R 2420/07; H04R 2460/13; H04R 25/606; H04R 25/652
USPC ..... 600/25; 381/170, 191, 326, 355, 361, 381/369, 380
See application file for complete search history.

(56) References Cited

U.S. PATENT DOCUMENTS

| | | | | |
|---|---|---|---|---|
| 7,214,179 | B2 * | 5/2007 | Miller et al. | 600/25 |
| 8,254,609 | B2 * | 8/2012 | Lin | 381/369 |
| 8,509,469 | B2 * | 8/2013 | Miller et al. | 381/361 |

OTHER PUBLICATIONS

Extended European Search Report in European Application No. 13793494.9, dated Apr. 28, 2015.

* cited by examiner

*Primary Examiner* — Brian Ensey
(74) *Attorney, Agent, or Firm* — Nixon Peabody LLP

(57) ABSTRACT

A hearing aid microphone assembly is configured for implantation into a subject and includes a microphone housing, the housing having a generally conical sound gathering portion with a proximal end and a distal end and a microphone support portion with one or more ports configured to receive a microphone and acoustically coupled to the distal end. A diaphragm is disposed over the proximal end of the housing to hermetically seal the sound gathering portion of the housing and create a first chamber. The microphone assembly is configured with either: (1) at least a first and a second port each coupled to a microphone; or (2) at least a first port coupled to a microphone and an accelerometer coupled to the housing. Each of the ports is configured to communicate acoustically with the first chamber. Any unused ports are sealed.

26 Claims, 5 Drawing Sheets

IMPLANTABLE MICROPHONE

RELATED APPLICATIONS

This application is a continuation-in part of U.S. patent application Ser. No. 13/478,056 filed on May 22, 2012 in the name of the same inventors and commonly assigned herewith.

TECHNICAL FIELD

The present disclosure relates generally to implantable microphones.

BACKGROUND

To create a fully implantable hearing aid, a suitable implantable microphone is required. Devices in the prior art have drawbacks which include the use of biocompatible membranes which evoke a biologic response causing a fibrous capsule to grow around the microphone. This generally results in decreased sensitivity over time. Such devices also tend to be larger than desirable and therefore cannot be implanted in the ear canal (the most desirable location). Other prior art devices lack the required sensitivity for such a long-term application. Devices inserted (not implanted) directly into the ear canal tend to be subject to damage from foreign objects (e.g., Q-tips). Devices attached to the skull (mastoid) are subjected to vibration from chewing and talking. These vibrations may be picked up by the microphone and amplified resulting in an unnatural sound. An improved implantable hearing aid microphone would be desirable which does not react substantially with the body, avoids pick-up of low-frequency vibrations (e.g., heartbeat, chewing sounds, glottal sounds and the like), is small enough to be implanted in the ear canal, and is not subject to foreign object damage.

OVERVIEW

A hearing aid microphone assembly is configured for implantation into a subject and includes a microphone housing, the housing having a generally conical sound gathering portion with a proximal end and a distal end and a microphone support portion with one or more ports configured to receive a microphone and acoustically coupled to the distal end. A diaphragm is disposed over the proximal end of the housing to hermetically seal the sound gathering portion of the housing and create a first chamber. The microphone assembly is configured with either: (1) at least a first and a second port each coupled to a microphone; or (2) at least a first port coupled to a microphone and an accelerometer coupled to the housing. Each of the ports is configured to communicate acoustically with the first chamber. Any unused ports are sealed.

BRIEF DESCRIPTION OF THE DRAWINGS

The accompanying drawings, which are incorporated into and constitute a part of this specification, illustrate one or more examples of embodiments and, together with the description of example embodiments, serve to explain the principles and implementations of the embodiments.

In the drawings.

DESCRIPTION OF EXAMPLE EMBODIMENTS

Example embodiments are described herein in the context of an implantable hearing aid microphone assembly. Those of ordinary skill in the art will realize that the following description is illustrative only and is not intended to be in any way limiting. Other embodiments will readily suggest themselves to such skilled persons having the benefit of this disclosure. Reference will now be made in detail to implementations of the example embodiments as illustrated in the accompanying drawings. The same reference indicators will be used to the extent possible throughout the drawings and the following description to refer to the same or like items.

In the interest of clarity, not all of the routine features of the implementations described herein are shown and described. It will, of course, be appreciated that in the development of any such actual implementation, numerous implementation-specific decisions must be made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

Figure 1:
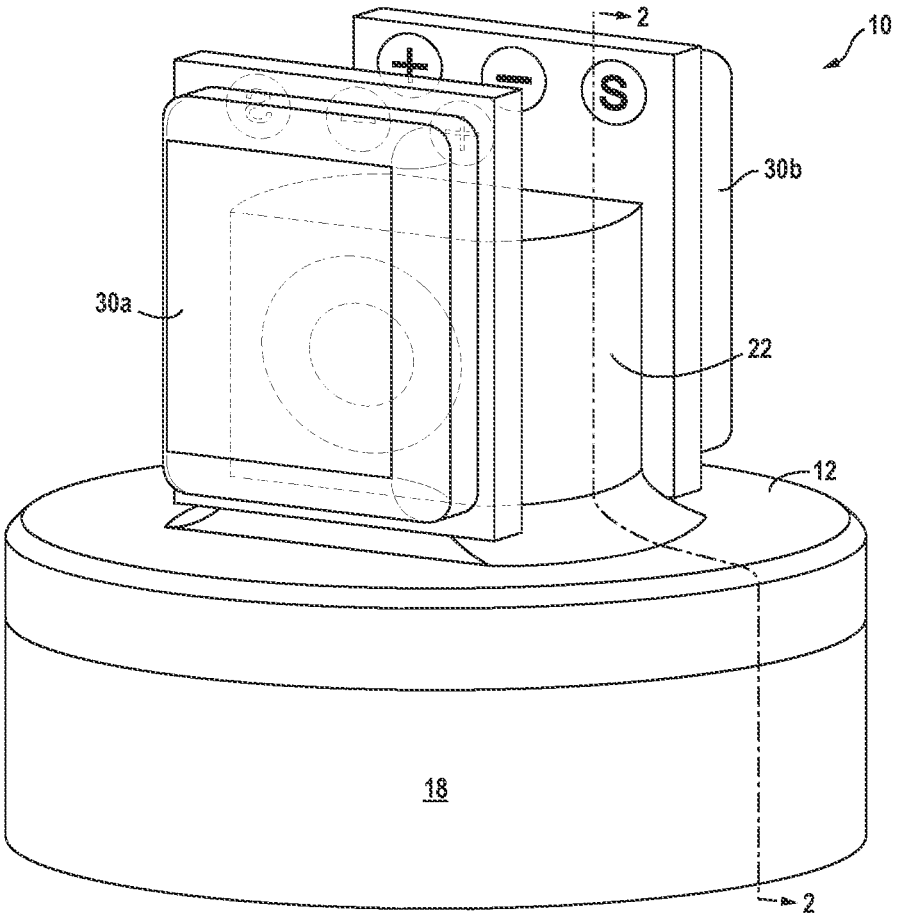
FIG. 1 is a side perspective view of an implantable hearing aid microphone assembly in accordance with an embodiment.
Figure 2:
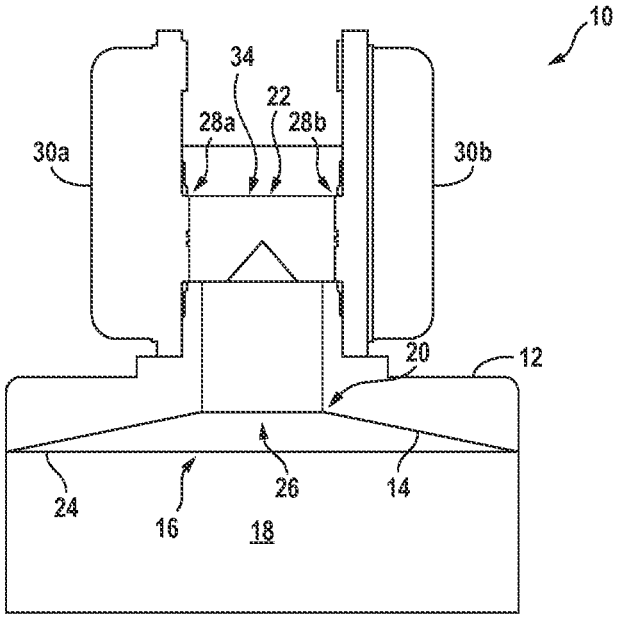
FIG. 2 is a cross-sectional elevational view of the implantable hearing aid microphone assembly of FIG. 1 taken along line 2-2 thereof.
Figure 3:
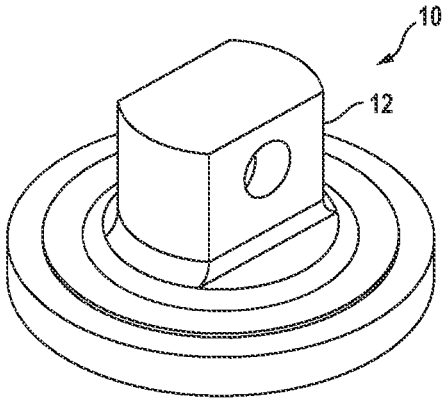
FIG. 3 is a front perspective view of an implantable hearing aid microphone assembly housing in accordance with one embodiment.
Figure 4:
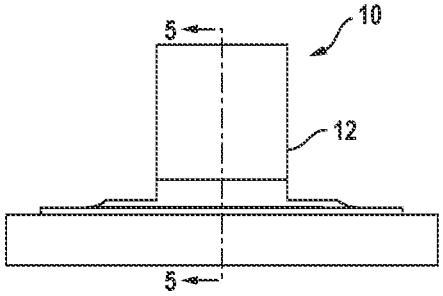
FIG. 4 is a side elevational view of the implantable hearing aid microphone assembly housing of FIG. 3.
Figure 5:
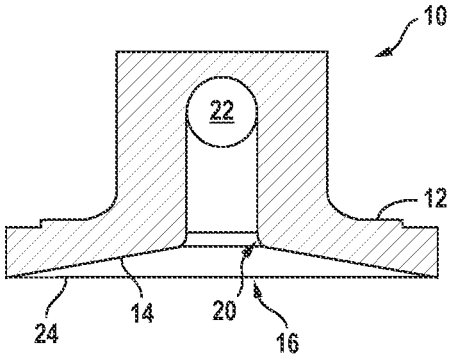
FIG. 5 is a cross-sectional elevational view of the implantable hearing aid microphone assembly of FIG. 4 taken along line 5-5 thereof.

FIG. 1 is a side perspective view of an implantable hearing aid microphone assembly 10 in accordance with an embodiment and FIG. 2 is a cross-sectional elevational view of the implantable hearing aid microphone assembly 10 of FIG. 1 taken along line 2-2 thereof. FIG. 3 is a front perspective view of an implantable hearing aid microphone assembly housing in accordance with one embodiment. FIG. 4 is a side elevational view of the implantable hearing aid microphone assembly housing of FIG. 3. FIG. 5 is a cross-sectional elevational view of the implantable hearing aid microphone assembly of FIG. 4 taken along line 5-5 thereof.

The microphone assembly 10 includes a microphone housing 12 having a generally conical sound gathering portion 14 with a proximal end 16 (closest to the subject's skin 18) and a distal end 20, and a microphone support portion 22 acoustically coupled to the distal end 20 of the sound gathering portion 14. A diaphragm 24 is disposed over the proximal end 16 of the housing 12 to hermetically seal the sound gathering portion 14 of the housing and create a first chamber 26. In one embodiment the microphone support portion 22 includes at least a pair of ports 28*a* and 28*b*. Ports 28*a* and 28*b* are acoustically coupled to the first chamber 26 via the microphone support portion 22 so that sound picked up by the sound gathering portion is channeled to the ports. At least a first and a second microphone 30*a* and 30*b* are, in turn, coupled to the respective ports.

In one embodiment the housing 12 is machined from Grade 23 titanium. Other materials are also useable as will now be apparent to those of ordinary skill in the art. The circumferential perimeter of diaphragm 24 is, in one embodiment, formed of 25 um thick Grade 2 titanium and laser-welded to the housing at the perimeter of the proximal end 16 of the sound gathering portion 14. Other materials and attachment techniques are also useable as will now be apparent to those of ordinary skill in the art. The diaphragm may have a useful thickness in a range of about 5 um to about 100 um. It is thin enough to allow sound to pass through with little attenuation and has a diameter small enough so that it can be placed behind the skin of the ear canal.

A layer of skin, approximately 2 mm thick, covers the diaphragm 24 when implanted. The surgical procedure for implantation of the microphone assembly 10 calls for it to be implanted beneath the skin and the thin conchal cartilage that extends into the meatus of the posterior ear canal. The microphone assembly 10 is centered on the posterior wall of the external canal where the diaphragm 24 is tightly coapted against the 2 mm thick soft tissue of the posterior external canal meatus.

The microphones 30*a*, 30*b* may, in one embodiment, be Knowles QM-31351-000 0.25 mm port microphones available from Knowles Electronics of Itasca, Ill. These are microelectromechanical systems (MEMS)-type microphones which are also available from a number of other vendors and used in a variety of applications. Alternatively other small microphones could be used instead. In one embodiment the two microphones are connected to have the same response polarity to incoming sound, but exactly the opposite response polarity to vibration, so that when the two microphone signals are added together, the incoming sound signals will add constructively, while the vibration signals will cancel each other. Orienting the assembly so that the likely direction of vibration is tangential to the surface of the individual microphone inner diaphragms also enhances vibration rejection.

Microphone assembly 10 may have in one embodiment an overall diameter at the diaphragm 24 of 6.5 mm and an overall height from the diaphragm 24 to the top of the microphones of about 4.5 mm. Other dimensions within about a factor of two will work as well, e.g., diaphragm diameter in a range of about 3 mm to about 13 mm and an overall height in a range of about 2.5 mm to about 9 mm. The distance from the outer side of the diaphragm 24 to the center of ports 28*a*, 28*b* may in one embodiment be in a range of about 1 mm to about 4 mm. The ports 28*a*, 28*b* may in one embodiment have a cross-sectional circular shape having a diameter in a range of about 0.2 mm to about 2.2 mm.

In another embodiment a single microphone 30*a* may be mounted to port 28*a* and an accelerometer may be used instead of microphone 30*b* and mounted to housing 12 and oriented so that it detects acceleration in the direction of the axis along the top of the "T" 34 of the microphone support portion 22. In that case, the advantage of adding the microphone signals together is lost, but the cost of two microphones is avoided. The output of the accelerometer can be scaled and then added or subtracted as needed from the microphone signal to eliminate a vibration induced signal in the microphone output leaving just the acoustic signal. Mathematically speaking:

$$\text{Microphone output} = \text{acoustic signal} + \text{vibration signal}$$

$$\text{Accelerometer ouput} = \text{vibration signal}$$

$$\text{Microphone output} - \text{Accelerometer output} =$$

$$\text{acoustic signal} + (\text{vibration signal}) = \text{acoustic signal (only)}$$

Any gain, attenuation, scaling or equalization needed to match these respective sensor signals may be provided at the hearing aid instrument (not shown) to which the microphone assembly is coupled in conventional firmware. Note that is a two- or more port microphone support portion 22 is used in a one microphone configuration the unused ports must be sealed. Alternatively a microphone support portion 22 with a single port (not shown) may be used.

Figure 6:
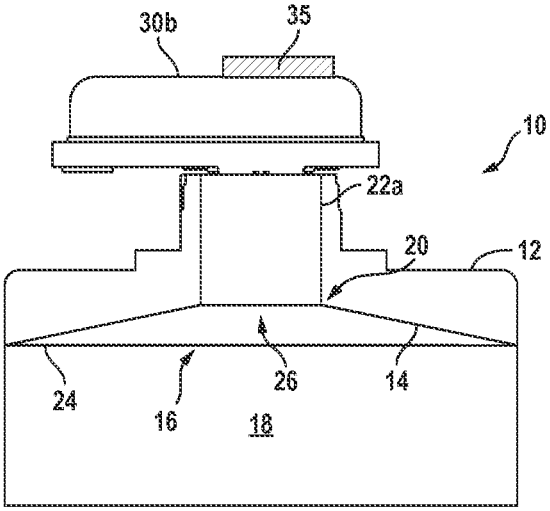
FIG. 6 is a cross-sectional elevational view of a single-microphone with accelerometer implantable hearing aid microphone assembly in accordance with one embodiment.

FIG. 6 is a cross-sectional elevational view of a single-microphone with accelerometer implantable hearing aid microphone assembly in accordance with one embodiment. In accordance with this embodiment, a single microphone 30*b* is coupled to a modified (single port) microphone support portion 22*a* of sound gathering portion 14 of housing 12. An accelerometer 35 is provided mounted to housing 12 at a convenient location.

Figure 7:
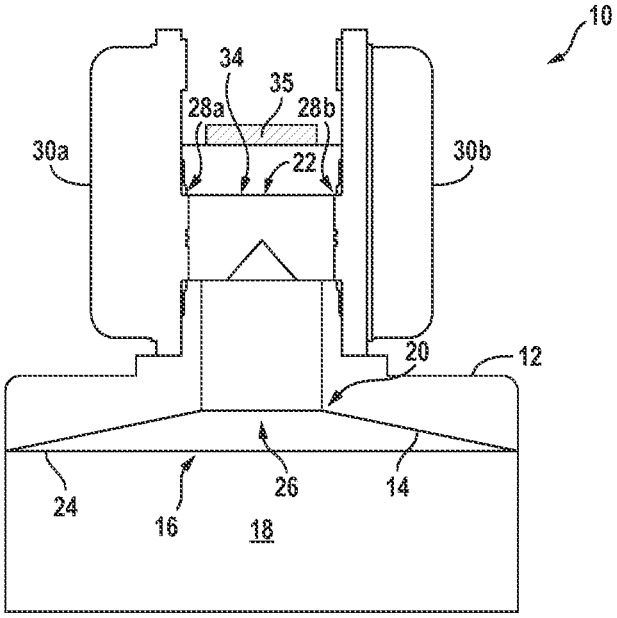
FIG. 7 is a cross-sectional elevational view of a double-microphone with accelerometer implantable hearing aid microphone assembly in accordance with one embodiment.

FIG. 7 is a cross-sectional elevational view of a double-microphone with accelerometer implantable hearing aid microphone assembly in accordance with one embodiment. In accordance with this embodiment, two microphones are provided as in the embodiment illustrated in FIG. 2. Additionally, accelerometer 35 is provided mounted to the microphone support portion 22. In this case the advantages of two microphones are obtained as well as an accelerometer signal to assist in vibration signal reduction as discussed above.

Figure 8:
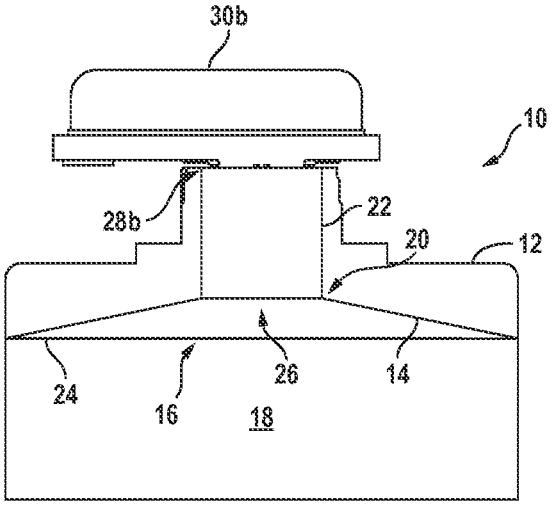
FIG. 8 is a cross-sectional elevational view of a single-microphone implantable hearing aid microphone assembly in accordance with one embodiment.

FIG. 8 is a cross-sectional elevational view of a single-microphone implantable hearing aid microphone assembly in accordance with one embodiment. In accordance with this embodiment a single microphone 30*b* is provided and is coupled to microphone support portion 22 at port 28*b*.

Figure 9A:
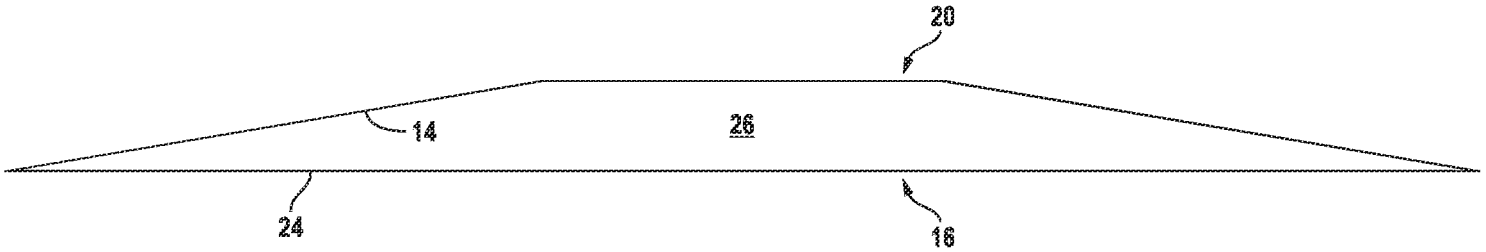
FIG. 9A is a cross-sectional elevation of the sound gathering portion shown as a conical section.
Figure 9B:
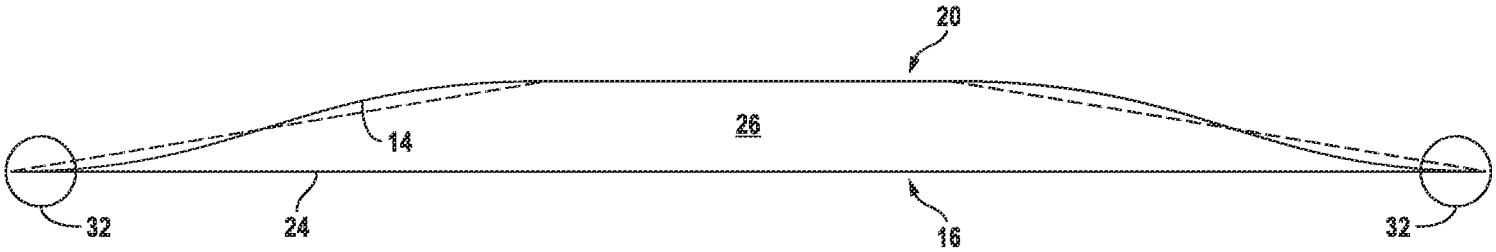
FIG. 9B is a cross-sectional elevation of the sound gathering portion in accordance with one embodiment illustrating (in an exaggerated fashion not to scale) a generally (but not precisely) conical arrangement deviating from a pure conical shape for reducing stress between the diaphragm and the sound gathering portion.

FIG. 9A is a cross-sectional elevation of the sound gathering portion shown as a conical section. FIG. 9B is a cross-sectional elevation of the sound gathering portion in accordance with one embodiment illustrating (in an exaggerated fashion not to scale) a generally (but not precisely) conical arrangement deviating from a pure conical shape for reducing stress between the diaphragm 24 and the sound gathering portion 14 at the circumferential welds 32. This arrangement is referred to as a contoured surface. The contoured surface version of the generally conical surface of the sound gathering portion 14 helps to prevent the diaphragm 24 from stressing beyond its yield strength and helps prevent damage from increases in air pressure or blunt external force.

Generally the microphone assembly should be designed to operate in a range of −1 to +3 atmospheres (ATM) relative to normal sea level pressure. This way if someone travels to a relatively low pressure environment (air travel) the unit will not fail. Similarly if they choose to go diving the unit will not fail up to a reasonable pressure. There is gas sealed inside the microphone assembly and normally pressurized at approximately 1 ATM. The gas may, for example, comprise air or, alternatively, a gas containing a higher percentage of nitrogen or even pure nitrogen. Other appropriate gasses and gas mixtures may be used as will now be apparent to those of ordinary skill in the art. The gas is enclosed in the microphones 30*a*, 30*b*, the sound gathering chamber 14, the microphone support portion 22 and the ports 28*a*, 28*b*. Thus +3 ATM applied to the diaphragm 24 should not cause a failure and −1 ATM applied to the diaphragm should be able to be withstood without failure of the diaphragm 24 or circumferential welds 32.

The microphone assembly is, in one embodiment, tethered to a hearing aid instrument by a cable supporting electrical connections between the hearing aid instrument and the microphone assembly (e.g., to the microphone(s) and any other sensor(s) on board the microphone assembly.

While embodiments and applications have been shown and described, it would be apparent to those skilled in the art having the benefit of this disclosure that many more modifications than mentioned above are possible without departing from the inventive concepts disclosed herein. The invention, therefore, is not to be restricted except in the spirit of the appended claims.

What is claimed is:

1. A hearing aid microphone assembly configured for implantation into a subject, comprising:

a microphone housing, the housing having a generally conical sound gathering portion with a proximal end and a distal end and a microphone support portion acoustically coupled to the distal end;

a diaphragm disposed over the proximal end of the housing to hermetically seal the sound gathering portion of the housing and create a first chamber;

the microphone support portion configured with at least a first and a second port, each of the first and second port configured to receive a microphone, and each of the ports configured to communicate acoustically with the chamber; and a first and a second microphone fixed respectively to the first and second ports such that the first and the second microphone are mounted outside of the microphone housing.

2. The assembly of claim 1, wherein the microphones are MEMS microphones.

3. The assembly of claim 1, wherein the housing has a maximum cross-sectional diameter of no more than about 13 mm.

4. The assembly of claim 1, wherein the diaphragm comprises titanium.

5. The assembly of claim 4, wherein the diaphragm has a thickness in a range of about 5 um to about 100 um.

6. The assembly of claim 1, wherein the housing comprises titanium.

7. The assembly of claim 1, wherein a distance from the outer side of the diaphragm to the center of the ports is less than about 4 mm.

8. The assembly of claim 1, wherein the ports have a cross-sectional circular shape having a diameter in a range of about 0.2 mm to about 2 mm.

9. The assembly of claim 1, wherein the generally conical sound gathering portion is provided with a contoured surface.

10. A hearing aid microphone assembly configured for implantation into a subject, comprising:

a microphone housing, the housing having a generally conical sound gathering portion with a proximal end and a distal end and a microphone support portion acoustically coupled to the distal end;

a diaphragm disposed over the proximal end of the housing to hermetically seal the sound gathering portion of the housing and create a first chamber;

the microphone support portion configured with at least a first port, the at least a first port configured to receive at least a first microphone and configured to communicate acoustically with the chamber;

the housing configured to receive an accelerometer; and a microphone fixed to the at least a first port and an accelerometer fixed to the housing such that the microphone is mounted outside of the microphone housing.

11. The assembly of claim 10, wherein the microphone is a MEMS microphone.

12. The assembly of claim 10, wherein the housing has a maximum cross-sectional diameter of no more than about 13 mm.

13. The assembly of claim 10, wherein the diaphragm comprises titanium.

14. The assembly of claim 13, wherein the diaphragm has a thickness in a range of about 5 um to about 100 um.

15. The assembly of claim 10, wherein the housing comprises titanium.

16. The assembly of claim 10, wherein a distance from the outer side of the diaphragm to the center of the ports is less than about 4 mm.

17. The assembly of claim 10, wherein the ports have a cross-sectional circular shape having a diameter in a range of about 0.2 mm to about 2 mm.

18. The assembly of claim 10, wherein the generally conical sound gathering portion is provided with a contoured surface.

19. A hearing aid microphone assembly configured for implantation into a subject, comprising:

a microphone housing, the housing having a generally conical sound gathering portion with a proximal end and a distal end and a microphone support portion acoustically coupled to the distal end;

a diaphragm disposed over the proximal end of the housing to hermetically seal the sound gathering portion of the housing and create a first chamber;

the microphone support portion configured with at least a first port, the at least a first port configured to receive a microphone, and the at least a first port configured to communicate acoustically with the chamber; and at least a first microphone fixed respectively to the at least a first port such that the first microphone is mounted outside of the microphone housing.

20. The assembly of claim 19, wherein the at least a first microphone is a MEMS microphone.

21. The assembly of claim 19, wherein the housing has a maximum cross-sectional diameter of no more than about 13 mm.

22. The assembly of claim 19, wherein the diaphragm comprises titanium.

23. The assembly of claim 22, wherein the diaphragm has a thickness in a range of about 5 um to about 100 um.

24. The assembly of claim 19, wherein the housing comprises titanium.

25. The assembly of claim 19, wherein the at least a first port has a cross-sectional circular shape having a diameter in a range of about 0.2 mm to about 2 mm.

26. The assembly of claim 19, wherein the generally conical sound gathering portion is provided with a contoured surface.

* * * * *